US006039014A

United States Patent [19]

Hoppie

[11] Patent Number: 6,039,014

[45] Date of Patent: Mar. 21, 2000

[54] SYSTEM AND METHOD FOR REGENERATIVE ELECTROMAGNETIC ENGINE VALVE ACTUATION

[75] Inventor: Lyle O. Hoppie, West Bloomfield, Mich.

[73] Assignee: Eaton Corporation, Cleveland, Ohio

[21] Appl. No.: 09/088,340

[22] Filed: Jun. 1, 1998

[51] Int. Cl.[7] ..... F01L 9/04

[52] U.S. Cl. ..... 123/90.11; 251/129.01; 251/129.1; 251/129.15; 335/256; 335/266

[58] Field of Search ..... 123/90.11; 335/256, 335/266, 268; 251/129.01, 129.05, 129.06, 129.09, 129.1, 129.15

[56] References Cited

U.S. PATENT DOCUMENTS

| | | | |
|---|---|---|---|
| 3,491,319 | 1/1970 | Cox et al. | 335/259 |
| 4,749,167 | 6/1988 | Gottschall | 251/65 |
| 4,779,582 | 10/1988 | Lequesne . | |
| 4,794,890 | 1/1989 | Richeson, Jr. . | |
| 4,831,973 | 5/1989 | Richeson, Jr. . | |
| 4,908,553 | 3/1990 | Hoppie et al. . | |
| 4,955,334 | 9/1990 | Kawamura . | |
| 4,972,810 | 11/1990 | Kawamura . | |
| 4,984,541 | 1/1991 | Kawamura | 123/90.11 |
| 5,069,422 | 12/1991 | Kawamura | 251/129.1 |
| 5,070,826 | 12/1991 | Kawamura . | |
| 5,076,221 | 12/1991 | Kawamura . | |
| 5,076,222 | 12/1991 | Kawamura . | |
| 5,111,779 | 5/1992 | Kawamura . | |
| 5,115,772 | 5/1992 | Kawamura . | |
| 5,124,598 | 6/1992 | Kawamura | 310/30 |
| 5,125,370 | 6/1992 | Kawamura . | |
| 5,197,428 | 3/1993 | Hornby . | |
| 5,222,714 | 6/1993 | Morinigo . | |
| 5,269,269 | 12/1993 | Kreuter . | |
| 5,322,258 | 6/1994 | Bosch et al. . | |
| 5,406,241 | 4/1995 | Kawamura | 335/227 |
| 5,422,617 | 6/1995 | Brown | 335/267 |
| 5,507,316 | 4/1996 | Meyer . | |
| 5,592,905 | 1/1997 | Born . | |
| 5,669,341 | 9/1997 | Ushirono et al. . | |
| 5,682,846 | 11/1997 | Scharnweber . | |
| 5,690,064 | 11/1997 | Izuo . | |
| 5,690,066 | 11/1997 | Hampton . | |
| 5,785,016 | 7/1998 | Enderle et al. | 123/90.11 |
| 5,884,591 | 3/1999 | Giese | 123/90.11 |

FOREIGN PATENT DOCUMENTS

| | | | |
|---|---|---|---|
| 2-291412 | 12/1990 | Japan | 123/90.11 |
| 3-81511 | 4/1991 | Japan | 123/90.11 |
| 5-312013 | 11/1993 | Japan | 123/90.11 |

*Primary Examiner*—Weilun Lo
*Attorney, Agent, or Firm*—Loren H. Uthoff, Jr.

[57] ABSTRACT

A system for actuating an engine valve includes a linear machine having a coaxially aligned field assembly and armature assembly. In one embodiment, the field assembly reciprocates relative to the armature assembly to actuate the valve. One configuration has a field assembly with a number of axially oriented annular permanent magnets separated by a ferromagnetic material and mounted on a non-magnetic shaft. The ferromagnetic material is preferably a compressed powdered metal which is microencapsulated with insulating material to reduce the formation of eddy currents. The preferred construction provides a reluctance force which helps maintain the valve in an open or closed state without any current applied to the armature. The system may also include an inductor and/or a capacitor tuned to the natural frequency chosen to provide regenerative actuation at a predetermined natural frequency.

9 Claims, 4 Drawing Sheets

26
20
92
62
66
34
67
28
50
52
60
54
56
68
64
58
38
32
88
84
86
82
ROM
RAM
DRIVERS
PROCESSOR
80
PCM
90
24
74
72
30
70
36
44
22
40
42
46

FIG 5
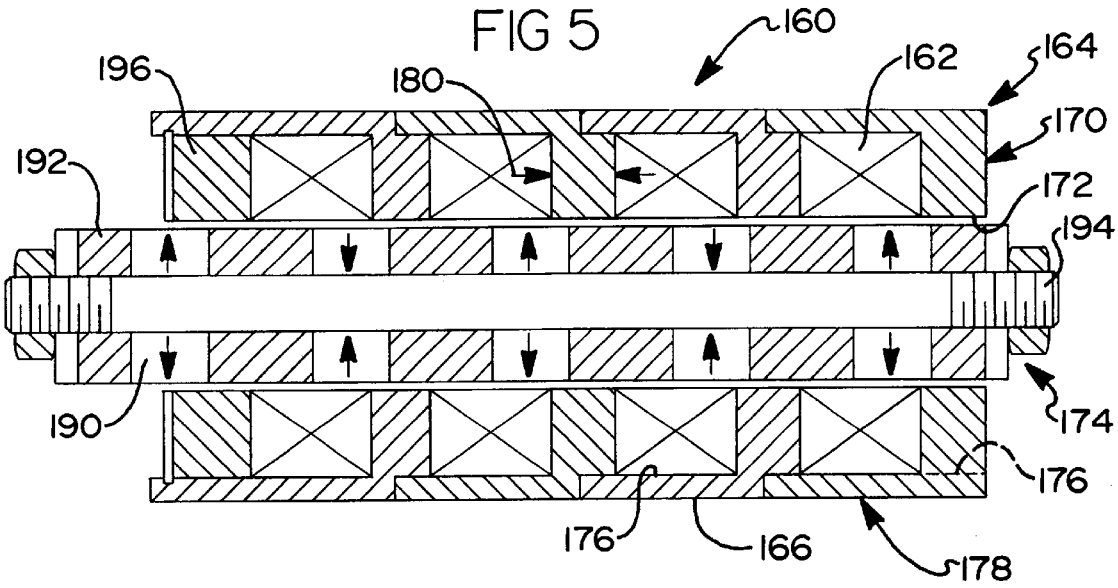
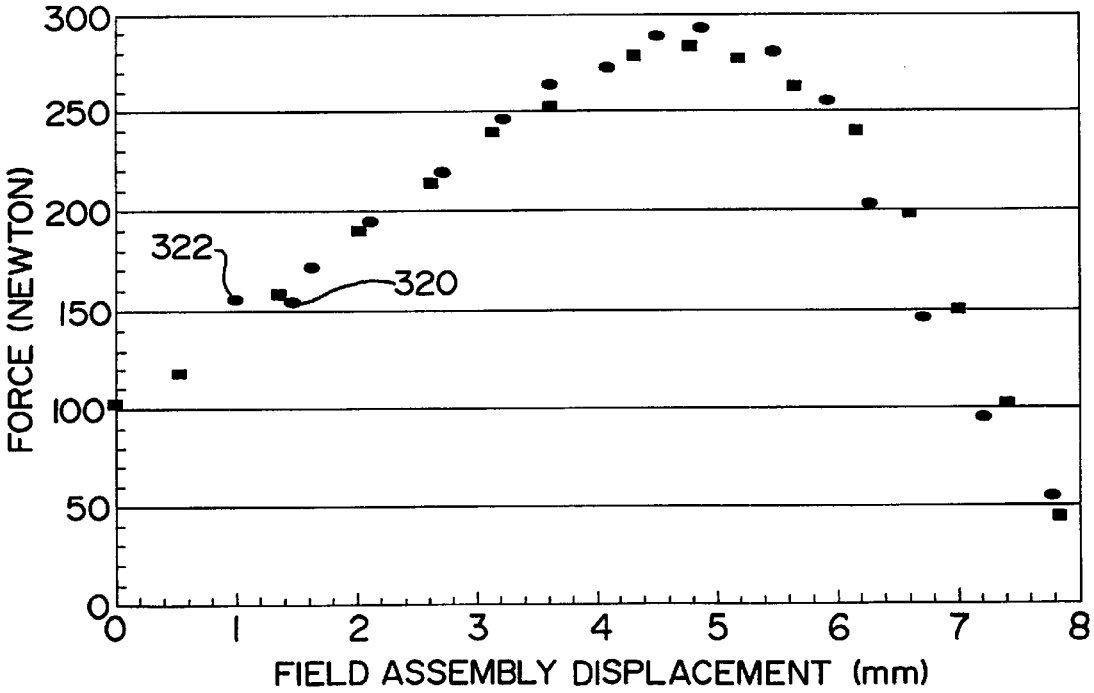
FIG 6

SYSTEM AND METHOD FOR REGENERATIVE ELECTROMAGNETIC ENGINE VALVE ACTUATION

RELATED APPLICATIONS

This application is related to U.S. Ser. No. 09/088,388 having an attorney's docket no. 96-rECD-537-2 filed on the same date as this application and entitled "Lamination Structure For An Electromagnetic Device" and assigned to the same assignee, Eaton Corporation, as in this application.

TECHNICAL FIELD

The present invention relates to a system and method for providing regenerative valve actuation for internal combustion engines using a linear machine.

BACKGROUND ART

Conventional internal combustion engines use a camshaft and associated linkages to open and close intake and exhaust valves during engine operation. As such, the valve timing is determined during design and manufacturing and remains fixed throughout the life of the engine, neglecting changes due to wear. Determination of the valve timing requires a compromise between engine performance, fuel economy, and emissions based on a typical application for a particular engine model. As such, it is desirable to vary the intake and/or exhaust valve actuation timing based on current engine operating parameters to optimize engine performance, fuel economy, and emissions. In addition, variable valve timing may be used to provide an engine braking function.

A number of approaches have been used to increase the control authority over operation of engine intake and exhaust valves. While hydraulic assisted/controlled valve actuators provide some benefits associated with variable valve timing, electronic or electromagnetic actuators are more versatile for a variety of applications. Electromagnetic valve actuators allow direct electronic control of the engine valves. In addition to controlling the timing of the opening and closing of the valve, the valve displacement can be varied in accordance with current engine operating conditions.

A variety of design and implementation challenges must be overcome to provide a commercially viable electromagnetic valve actuator. Energy efficiency of the actuator should be considered so that the benefits of variable valve timing are not defeated by additional power requirements of the actuator as compared to a mechanical or hydromechanical system. In addition, the actuator should be capable of providing a sufficient force to accelerate the valve with a relatively high peak acceleration (3500 m/sec$^2$ for example) while controlling the valve closing velocity to a small value(preferably less than 1 m/sec).

SUMMARY OF THE INVENTION

Thus, it is an object of the present invention to provide a system and method for engine valve actuation which minimizes mass movement to achieve high peak acceleration and a controllable closing velocity.

Another object of the present invention is to provide an energy efficient system for engine valve actuation which uses a regenerative electromagnetic actuator arrangement.

A further object of the present invention is to provide an electromagnetic engine valve actuator having a geometry which reduces coil end turns to reduce losses and improve efficiency.

Yet another object of the present invention is to provide a system for engine valve actuation which generates a reluctance force to maintain the valve in an open or closed position.

An additional object of the present invention is to provide an engine valve actuator having armature coils positioned to facilitate active and passive cooling.

A further object of the present invention is to provide an electromagnetic actuator which uses laminations or microencapsulation to reduce eddy current formation.

A still further object of the present invention is to provide a linear DC machine for use as an engine valve actuator so that valve opening and closing may be controlled based on engine operating parameters.

In carrying out the above objects and other objects, features, and advantages of the present invention, an electromagnetic actuator for providing linear motion includes an armature assembly having a plurality of coils connected and arranged so as to provide an axially alternating pattern with ferromagnetic material disposed therebetween, the armature assembly creating a first magnetic field when current is applied thereto, and a field assembly having a plurality of elements arranged in an axially alternating pattern with ferromagnetic material disposed therebetween, the field assembly being coaxially aligned with the armature assembly and creating a second magnetic field which interacts with the first magnetic field to cause linear motion of the field assembly relative to the armature assembly.

A system for actuating an intake or exhaust manifold valve in an internal combustion engine is also disclosed. The system includes a linear machine including a cylindraceous field assembly and a coaxially aligned cylindraceous armature assembly where, in one embodiment, the field assembly is linearly displaced relative to the armature assembly when a current is applied to the armature assembly. The system also includes a manifold valve mechanically coupled to the linear machine, and a controller electrically connected to the armature for selectively supplying the current and reversing the polarity of the current to actuate the manifold valve. The system may include an interface circuit to connect the controller to the machine which has predetermined values of inductance and equivalent capacitance. The interface circuit may include an inductor and/or a capacitor in order to provide a regenerative arrangement with a predetermined natural frequency.

The present invention has a number of associated advantages. For example, the present invention allows direct control of valve actuation for internal combustion engines. The present invention provides embodiments which use stationary armature coils positioned on the outside of the actuator to reduce losses due to end turns, improve cooling, and provide a reciprocating assembly with a lower mass. In addition, a movable electrical connection is not required provided a permanent magnet field is utilized. The present invention provides an actuator having an armature with fewer end turns to further improve efficiency and increase the energy/volume ratio. Ferromagnetic material is used in conjunction with a variable air gap to provide a reluctance force which tends to maintain the end positions of the actuator without an applied current. Efficiency of an actuator according to the present invention may be further increased by using the actuator in association with an interface circuit.

The above objects and other objects, features, and advantages of the present invention will be readily appreciated by one of ordinary skill in this art from the following detailed description of the best mode for carrying out the invention when taken in connection with the accompanying drawings.

BRIEF DESCRIPTION OF THE DRAWINGS

FIG. 5 illustrates a prototype linear actuator constructed using encapsulated powdered iron according to the present invention;

FIG. 6 is a graph illustrating force as a function of displacement for two embodiments of linear actuators according to the present invention.

BEST MODE(S) FOR CARRYING OUT THE INVENTION

Figure 1:
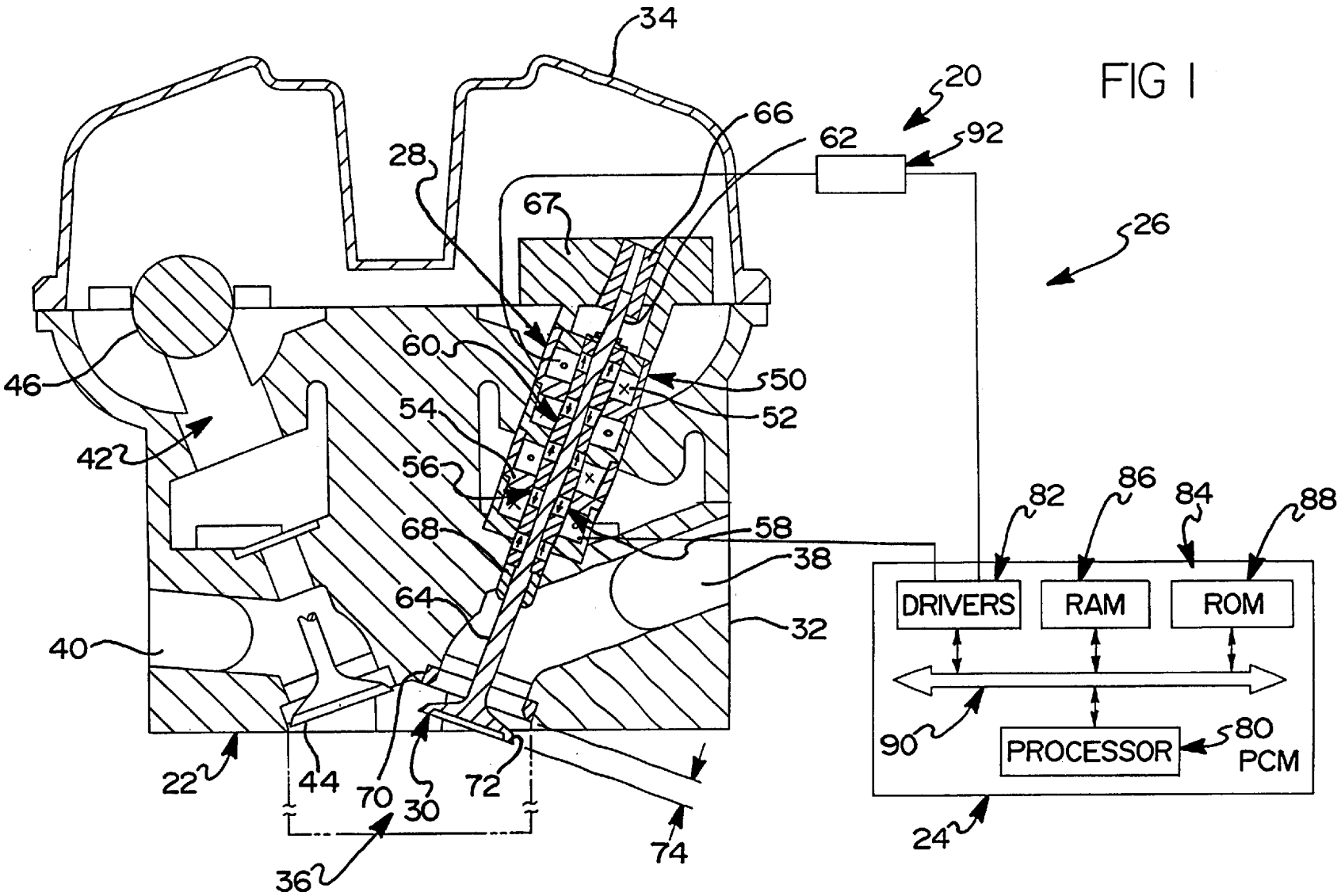
FIG. 1 is a partial cross-section and block diagram illustrating one embodiment for an engine valve actuator according to the present invention.

Certain terminology used in the following description is for convenience only and will not be limiting. The words "upwardly", "downwardly", "rightwardly", and "leftwardly" will designate directions in the drawings to which reference is made. The words "forward" and "rearward", will refer respectively to the front and rear ends of an engine as conventionally mounted in a vehicle. The words "inwardly" and "outwardly" will refer to directions toward and away from, respectively, the geometric center of the device and designated parts thereof. This terminology will include the words above specifically mentioned, derivatives thereof, and words of similar import.

FIG. 1 illustrates a system for regenerative engine valve actuation according to the present invention. System 20 includes an engine 22 in electrical communication with a controller 24 (such as a powertrain control module or PCM) via an interface circuit 26. Engine 22 includes at least one linear actuator 28 for actuating an engine valve, such as intake valve 30. Engine 22 represents any internal combustion engine including spark ignition, compression ignition, two-cycle, four-cycle, and alternative fuel engines. Actuator 28 is mounted within cylinder head 32, beneath valve cover 34, and is by cap 67. Cylinder head 32 defines the upper portion of cylinders 36 which are formed within the engine block (not shown). Cylinder head 32 includes various passages, such as intake port 38 and exhaust port 40 to provide selective fluid communication between cylinders 36 and atmosphere.

In the embodiment illustrated in FIG. 1, actuator 28 is used to control an intake valve 30. However, one of ordinary skill in the art will recognize that actuator 28 could also be used as an exhaust valve actuator. Each cylinder 36 may include one or more valve actuators 28. Of course, depending upon the particular application, various design parameters may be modified to provide the appropriate opening force, closing force, and desired displacement profile. Actuator 28 may be used to replace one or more conventional valve assemblies, such as would occupy the space 42 and which would include an engine valve 44 operatively associated with a camshaft 46. Because of the mechanical linkage between engine valve 44 and camshaft 46, the timing of the valve opening and closing must be determined when the engine is designed and manufactured and is substantially fixed regardless of the engine operating parameters, engine wear, and the like. As such, the present invention provides significant advantages over conventional valve assemblies by improving control of valve opening and closing as explained in greater detail below.

Actuator 28 includes an armature assembly 50 having a plurality of coils 52 connected and arranged so as to provide an axially alternating pattern with ferromagnetic material 54 disposed therebetween. Armature assembly 50 creates a first magnetic field when current is applied by controller 24 via circuit 26. Actuator 28 also includes a field assembly 56 having a plurality of elements 58 arranged in an axially alternating pattern with ferromagnetic material 60 disposed therebetween. Field assembly 56 is coaxially aligned with armature assembly 50 and creates a second magnetic field which interacts with the first magnetic field to cause linear motion of field assembly 56 relative to armature assembly 50. In the embodiment illustrated in FIG. 1, armature assembly 50 is mounted within cylinder head 32 and is relatively fixed while field assembly 56 reciprocates within armature assembly 50.

In one embodiment of the present invention, the plurality of elements 58 in field assembly 56 includes a plurality of coils each with a predetermined number of turns of an insulated conductor. The coils are interconnected such that the localized magnetic fields produced by elements 58 will have opposite polarities, poles, or polar orientations as schematically shown by "X" and "O" nomenclatures in FIG. 1. In a preferred embodiment such as illustrated in FIG. 1, field assembly 56 includes a plurality of permanent magnets which are preferably axially magnetized and arranged such that like poles of proximate magnets separated by ferromagnetic material 60 face one another.

Actuator 28 preferably includes a non-magnetic shaft 62 secured to field assembly 56 and coaxially aligned with field assembly 56 and armature assembly 50. Shaft 62 is preferably connected to valve stem 64 such that reciprocating motion of field assembly 56 results in corresponding reciprocating motion of valve stem 64 to open and close valve 30. In one preferred embodiment, actuator 28 includes an upper guide or insert 66 which cooperates with shaft 62 and a lower valve guide 68 which cooperates with valve stem 64. Depending on the rigidity of the material selected for shaft 62 and valve stem 64, it may be desirable to coat field assembly 56 with an insulating spacer to form a linear bushing between field assembly 56 and armature assembly 50 due to the force of attraction therebetween. Such a coating or bushing keeps field assembly properly aligned within armature assembly 50.

As also shown in FIG. 1, a valve seat insert 70 may be provided to cooperate with valve head 72 in sealing the combustion chamber. In operation, valve 30 reciprocates between a maximum travel position 74 and a seated position in which valve head 72 seats against insert 70. Shaft 62 may be connected to valve stem 64 in any conventional manner. In one preferred embodiment, shaft 62 and valve stem 64 form an integral, unitary structure with valve stem portion 64 having a larger diameter than shaft portion 62. In this embodiment, shaft 62 and valve stem 64 are formed of 316 stainless steel. Of course, shaft 62 and valve stem 64 may be made of different material and joined by any suitable method without departing from the spirit of the present invention.

As also illustrated in FIG. 1, controller 24 includes a processor 80 in communication with driver circuitry 82 and computer readable storage media 84 which may include various types of volatile and non-volatile memory, for example. Such memory may include random access memory (RAM) 86 and read-only memory (ROM) 88. Processor 80 may communicate with driver circuitry 82 and computer readable storage media 84 via an address/data/control bus 90. Computer readable storage media 84 may be implemented by any of the number of known volatile and non-volatile storage devices including but not limited to PROM, EPROM, EEPROM, flash memory, and the like.

Processor 80 implements control logic to selectively supply current and reverse its polarity to control actuator 28 to actuate valve 30. Controller 24 receives signals from various sensors (not shown) which reflect current operating conditions of engine 22. The control logic executed by processor 80 may be implemented in hardware, software, or any combination of hardware and software. Preferably, processor 80 is a microprocessor which executes instructions stored in computer readable storage media 84 to control actuator 28. In one embodiment, processor 80 would generate a command for driver circuitry 82 which would apply a variable voltage directly to actuator 28 so as to produce a predetermined valve position profile to open valve 30 during the initial portion of the intake stroke of cylinder 36. Once in the fully open position, the current supplied by controller 24 would be set equal to zero and the inherent reluctance force of the actuator would maintain the intake valve in the fully open position for a sufficient period of time to accept a charge of air (and fuel in some applications). Processor 80 would also generate a subsequent command to generate a similar voltage with opposite polarity to cause actuator 28 to close valve 30 at the end of the intake stroke of cylinder 36. Ideally, the profiles of the current pulses would result in a high peak acceleration and deceleration during both opening and closing of the valve with a substantially zero terminal velocity both when valve 30 reaches maximum travel 74 and is closed against valve insert 70 in a manner to control valve closing velocity to an acceptable valve.

Because actuator 28 operates as a linear DC machine, the impedance of actuator 28 consists of a resistive term, an inductive term, and one term that is similar to that of a capacitor (as shown in U.S. Pat. No. 4,908,553 hereby incorporated by reference in its entirety). Thus, in a second embodiment, actuator 28 can be coupled to controller 24 via a suitable inductor or capacitor shown in FIG. 1 as a reactance 92 so as to form a tuned L-C circuit and thus provide a regenerative system. A damped sinusoidal acceleration profile at a prescribed natural frequency can be obtained by tuning the L and C of the system to provide the desired natural frequency. In this embodiment, the voltage applied by drivers 82 of the controller 24 would be constant during the valve-opening event. The valve would automatically accelerate as it begins to open, then it would automatically decelerate as it approaches the fully open position during one complete sinusoidal cycle of the naturally oscillating system. At the end of this single complete sinusoidal cycle of acceleration, the applied voltage would be reduced to zero and the valve would be permitted to dwell in the open position. To subsequently close the valve, the voltage supplied by controller 24 would be reversed and the system would again be permitted to operate naturally for one complete sinusoidal cycle of acceleration as to accelerate the valve in the closing direction and then decelerate the valve as it approaches valve seat 70.

Figure 4:
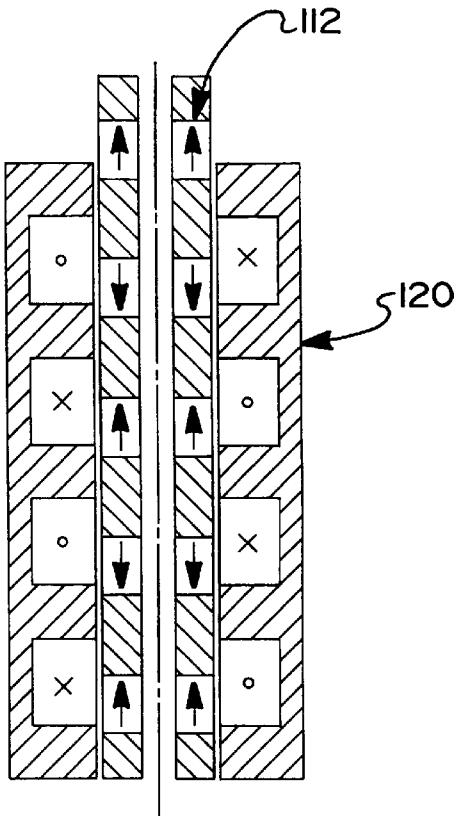
FIG. 4 illustrates a linear actuator according to the present invention shown in an upper position of maximum travel.
Figure 3:
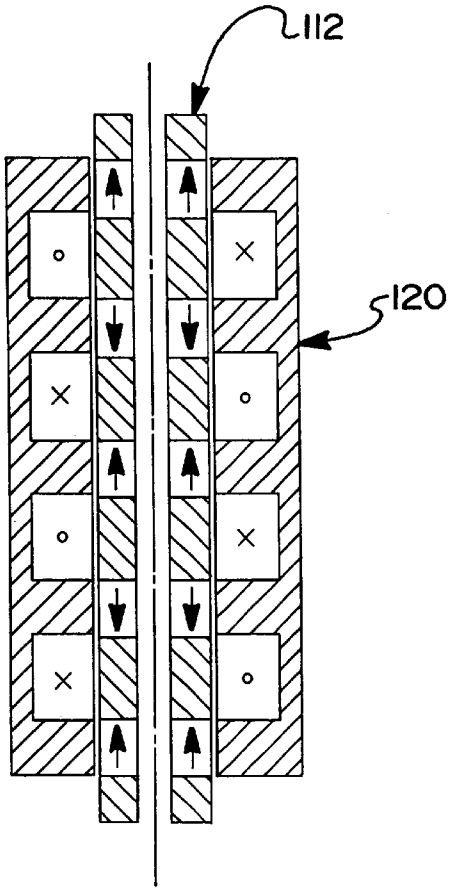
FIG. 3 illustrates a linear actuator according to the present invention shown in an intermediate position.
Figure 2:
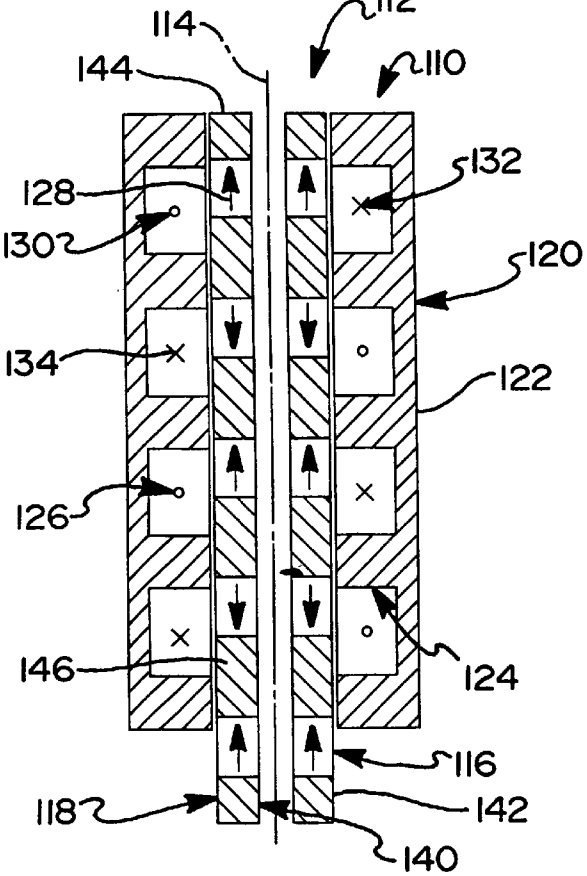
FIG. 2 illustrates another embodiment of a linear actuator according to the present invention shown in a lower position of maximum travel.

Referring now to FIGS. 2–4, an alternative embodiment of a linear machine for use as an actuator according to the present invention is shown in a lower position of maximum travel, at an intermediate position, and at an upper position of maximum travel respectively. Machine 110 includes an annular field assembly 112 coaxially aligned relative to axis 114. Field assembly 112 includes a first plurality of annular field elements 116 each creating a generally axially oriented magnetic field. Field assembly 112 also includes a plurality of annular ferromagnetic elements 118 alternatingly interposed the ferromagnetic elements 116. An annular armature assembly 120 is coaxially aligned with field assembly 112 along axis 114. Armature assembly 120 includes a generally cylindrical or cylindraceous ferromagnetic housing 122 having a plurality of axially spaced members 124 extending radially inward toward field assembly 112 and separating each of a plurality of coils, generally indicated by reference numeral 126. As shown in FIGS. 2–4, arrows 128 indicate the orientation or polarity of the magnetic field elements 116 with the arrowhead corresponding to "North" and the tail of the arrow corresponding to "South". The winding direction of coils 126 is indicated using a "dot" to denote conductors extending out of the page, as indicated by reference numeral 130, and an "x" to denote conductors extending into the page, as indicated by reference numerals 132 and 134. Preferably, coils 126 are connected in series and are formed of a single insulated conductor. Also preferably, annular field elements 116 are permanent magnets. In one preferred embodiment, the permanent magnet material is a neodymium-ironboron material, such as Crumax 2830 made by Crucible Magnetics. The Selected magnetic material preferably shows no demagnetization for temperatures as high as 185° C. where the magnetic field is in the first or second quadrant of the B-H plane.

Field assembly 112 is shown with five field elements 116 (axially polarized permanent magnets in one embodiment) and six ferromagnetic elements 118 assembled on a non-magnetic shaft (not shown). However, any number of field elements 116 and/or ferromagnetic elements 118 could be used according to the present invention. In one preferred embodiment, field assembly 112 reciprocates relative to armature assembly 120 to actuate an engine valve. However, one of ordinary skill in the art will recognize that armature assembly 120 may be connected to the valve shaft and reciprocate relative to a fixed field assembly. One skilled in the art will also recognize that the permanent magnet assembly could be configured outside the coil assembly.

A prototype for the embodiment illustrated in FIGS. 2–4 includes a field assembly 112 having an inner radius 140 of about 2 mm and an outer radius 142 of about 6 mm. Field magnetic elements 118 include end elements 144 having an axial length of about 4 mm and intermediate elements 146 having an axial length of about 8 mm. The prototype armature assembly 120 includes four coils 126 having an inner radius of about 6.5 mm, an outer radius of 13 mm and an axial length of about 9 mm. The outer radius of housing 122 for one prototype was about 15 mm. Ferromagnetic members 124 include inner members having an axial length of about 5 mm and outer members having an axial length of about 5.5 mm.

Preferably, the number of field elements 116 exceeds the number of coils 126 so the magnetic field at each of the end coils is substantially the same as at the inner coils. As such, the magnetic field at the end coils is about the same as at the inner coils whether the field assembly 112 is in the lower position illustrated in FIG. 2, the intermediate position illustrated in FIG. 3, or the upper position illustrated in FIG. 4. This condition would not prevail if the number of field elements 116 was less than or equal to the number of coils 126. For one embodiment of the present invention, field assembly 112 has an axial length of about 70 mm and provides a stroke or travel of about 8 mm. Armature assembly 120 has an axial length of about 62 mm so that the field assembly protrudes about 8 mm beyond the armature assembly as illustrated in FIGS. 2 and 4.

Coils 126 are preferably wet wound with a thermopoxy material such as P. D. George/Sterling U-300 thermopoxy, so that the finished coils do not have a mandrel. For the constructed prototype, the plurality of coils 126 were formed using an insulated conductor, such as AWG 21 copper wire. The resistance of the finished coils was about 0.250 ohms. The cross sectional area of the coils was about 58.5 $mm^2$. The coils are wound with a predetermined number of turns (such as 90), and the ends of the coils are interconnected so as to reverse the sense of adjacent coils as illustrated with the symbols "X" and "O" in FIGS. 2–4. As such, the adjacent coils generate magnetic fields having opposite sense (orientation or polarity) when a current is applied.

For a typical automotive application in a 4-cycle internal combustion engine, a generally sinusoidal current will be applied to the linear DC machine for only a fraction of each engine cycle (which spans two revolutions of the crankshaft). If an actuator according to the present invention is used to actuate an intake valve, a current pulse resembling a single full sinusoidal cycle will be applied to the armature with a first polarity to open the valve followed by a dwell time where the current is reduced or eliminated. A subsequent current pulse is applied with a reverse polarity to accelerate the valve in the opposite direction and close the valve at the end of the intake stroke. As such, current is generally applied for only about two-thirds of the intake stroke and therefore only about one-sixth of the engine cycle since the intake valve remains closed during the compression, power, and exhaust strokes. For a typical application, the RMS current density may be about 15 Amps per $mm^2$ with a peak current of about 53 Amps per $mm^2$. With a crosssectional coil area of about 58.5 $mm^2$, a peak value of about 3,000 Amp-turns would be expected.

To provide a valve opening/closing time of about 3 ms, an electrical frequency on the order of about 300 Hz will be experienced. The desired force versus displacement characteristics of the actuator result in ferromagnetic material having an axial length of several millimeters between adjacent coils. Because of these two factors, using solid steel as the ferromagnetic material would result in eddy currents which would severely limit performance of the actuator. As such, the ferromagnetic material is preferably a high permeability material with low eddy current loss characteristics.

FIG. 5 illustrates a preferred embodiment of a linear machine for use as an engine valve actuator according to the present invention. Actuator 160 includes a plurality of coils 162 forming an integral part of armature assembly 164. In this embodiment, armature assembly 164 includes a housing having a plurality of individual ferromagnetic housing components 166 fixed together to form an integral housing structure. Each of the individual ferromagnetic housing components 166 includes a first annular portion 170 having a first inside diameter 172 sized to accommodate field assembly 174. First annular portion 170 includes a first outside diameter 176 sized to accommodate armature coils 162. Housing components 166 also include a second annular portion 178 having a second inside diameter substantially equal to first outside diameter 176 and extending axially beyond the thickness 180 of the first annular portion 170.

As illustrated in FIG. 5, magnetic elements 190 of field assembly 174 may be radially oriented permanent magnets separated by ferromagnetic material 192. However, axially oriented permanent magnets provide better performance in certain applications. Similar to the embodiment illustrated in FIGS. 2–4, this embodiment includes a cylindraceous field assembly 174 including a non-magnetic shaft 194 coaxially aligned with a cylindraceous armature assembly 164.

In one preferred embodiment of the present invention, the ferromagnetic material used for housing components 166 is a microencapsulated powdered iron material such as Ancorsteel SC 100 manufactured by Hoeganaes Corporation. The ferromagnetic material should preferably exhibit negligible eddy currents up to and beyond the typical operating frequencies. For the SC 100 material used in one embodiment of the present invention, observed eddy currents were completely negligible up to about 1,000 Hz. Housing elements 166 are formed using a powdered metal fabrication process. The resultant permeability will depend upon the compression pressure used during fabrication. As shown in FIG. 5, four nesting or interlocked cup-shaped pieces are used for housing components 166. After coils 162 and housing components 166 are assembled, they are preferably vacuum/pressure impregnated to form an integral unit. In one embodiment, the armature assembly is impregnated with P. D. George/Pedigree No. 108 epoxy and No. 109 hardener.

Figure 7:
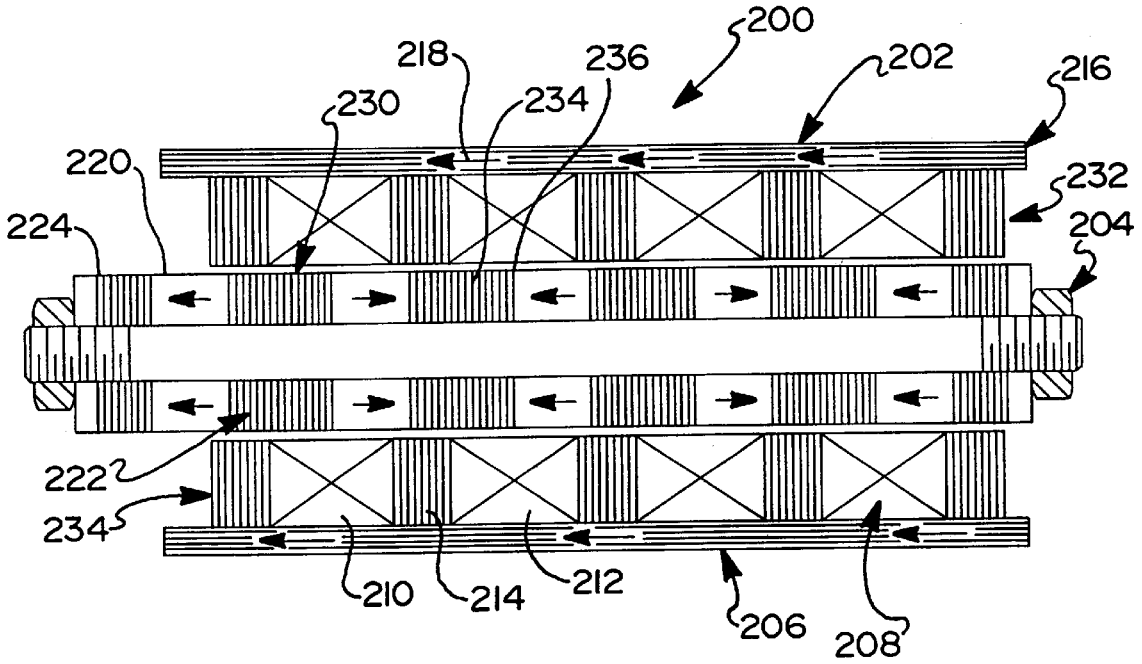
FIG. 7 illustrates another embodiment of a linear actuator utilizing laminated steel discs for the ferromagnetic material according to the present invention.

A graph illustrating force as a function of displacement for two embodiments of actuators according to the present invention is shown in FIG. 6. An actuator constructed as illustrated in FIG. 5 with an insulated powdered metal armature produced points 320 under simulated operating conditions. A 3 ms voltage pulse was applied and adjusted to produce a peak current of 33.3 A (3000 AT) which was the maximum anticipated value for this particular application. The graph illustrates the maximum value of force which occurred at the end of the applied voltage pulse. Points 322 were produced by an armature having a 1010 steel construction as illustrated in FIG. 7. The nearly identical values produced by the two embodiments suggests that the effective permeabilities were quite similar. This graph illustrates the effectiveness of laminations when selected and oriented according to the previously referenced co-pending application.

Another embodiment of a linear machine for use as an engine valve actuator according to the present invention is illustrated in FIG. 7.

Actuator 200 includes an armature assembly 202 which generally surrounds a field assembly 204 and is coaxially aligned relative thereto. Armature assembly 202 includes a ferromagnetic cylindraceous tube 206 surrounding a plurality of coils 208 which include proximate coils 210 and 212 separated by a plurality of annular field magnetic discs 214 disposed therebetween. Preferably, tube 206 includes a plurality of laminations or layers 216 which are generally coaxially aligned with field assembly 204. In one preferred embodiment, tube 206 is formed using a sheet of ferromagnetic material which is rolled to form a plurality of circumferential layers or laminations 216. Most preferably, tube 206 is formed using silicon steel with an axially oriented grain, indicated generally by arrows 218.

Field assembly 204 includes a plurality of field elements 220 axially separated by a plurality of ferromagnetic elements 222, which are preferably a plurality of steel discs 224. As explained in greater detail in copending application U.S. Ser. No. 09/088,388 having an attorney's docket No. 96-rECD-537-2 the ferromagnetic discs 224 preferably each have a thickness of about twice their associated skin depth to reduce eddy currents within the discs. In one embodiment of the present invention, field elements 22 include four sets of inner elements 230 and two sets of outer elements 32. Each of the inner elements 230 have about twenty discs 234 having an axial thickness or length of about 0.38 mm. This provides an axial length of about 8 mm for each inner element 230. Likewise, armature assembly 202 preferably includes five ferromagnetic elements 234 each having a plurality of ferromagnetic discs 214 with each disc having an axial thickness of about 0.38 mm. Tube 206 is preferably constructed using four turns of silicon steel having a thickness of about 0.279 mm with an axially oriented grain. Armature assembly 202 including tube 206, coils 208, and ferromagnetic elements 234 are preferably assembled and vacuum/pressure impregnated with an epoxy and hardener to form an integral unit, such as P. D. George/Pedigree No. 108 epoxy and No. 109 hardener.

While it is well known that laminations should generally be coplanar with the magnetic field to reduce eddy currents, a linear machine constructed according to the present invention will produce a magnetic field with both axial and radial components. As such, ideal laminations would be pie-shaped segments extending the entire length of the actuator. In practice, such laminations are difficult to produce. Therefore, laminations (discs) positioned in the directions illustrated in FIG. 7 are in the "wrong direction", i.e. against conventional wisdom, but result in acceptable operation provided the thickness and direction of the laminations, in addition to the number of laminations are selected appropriately. The disadvantage of using laminations is the inherent air gap between each lamination which tends to reduce the applied magnetic field. However, as the thickness of the elements increases, eddy currents with associated undesirable induced magnetic fields are produced. If the laminations are too thin, the air gaps will lead to a reduction of the desirable applied magnetic field. As such, the competing parameters must be considered in developing an optimum design for a particular application.

The mechanical, electrical, and magnetic characteristics of a linear valve actuator according to the present invention clearly depend upon the particular geometry and size. As such, one of ordinary skill in the art will recognize the scaling laws which will affect the final design for a particular application.

Thus, the present invention provides a linear actuator capable of generating sufficient force with a reasonable package size to directly actuate a valve for an internal combustion engine. In conjunction with a suitable controller, the actuator can control the engine valve to follow a predefined profile and provide regenerative braking of the decelerating valve to reduce closing velocity and increase operating efficiency.

It is understood, of course, that while the forms of the invention herein shown and described include the best mode contemplated for carrying out the present invention, they are not intended to illustrate all possible forms thereof. It will also be understood that the words used are descriptive rather than limiting, and that various changes may be made without departing from the spirit or scope of the invention as claimed below.

What is claimed is:

1. An electromagnetic actuator for providing linear motion, the actuator comprising:

an armature assembly having a plurality of circular coils arranged in an axially alternating pattern with ferromagnetic material disposed therebetween, the armature assembly creating a first magnetic field when current is applied thereto; and a field assembly having a plurality of axially magnetized permanent magnets arranged in an axially alternating pattern with ferromagnetic material disposed therebetween, the field assembly being coaxially aligned with the armature assembly and creating a second magnetic field which interacts with the first magnetic field to cause linear motion of the field assembly relative to the armature assembly.

2. The actuator of claim 1 wherein the armature assembly comprises an insulated conductor arranged with a predetermined number of turns in a first direction to form a first one of the plurality of coils and arranged with a predetermined number of turns in a second direction to form a second one of the plurality of coils, the second coil being proximate the first coil separated by the ferromagnetic material.

3. The actuator of claim 1 wherein the plurality of axially magnetized permanent magnets are arranged such that like poles of proximate magnets separated by the ferromagnetic material face one another.

4. The actuator of claim 1 wherein the armature assembly surrounds the field assembly and wherein the armature assembly comprises a ferromagnetic tube surrounding the plurality of coils the tube having a purality of axially spaced ferromagnetic members extending radially inward toward the field assembly to separate the coils.

5. The actuator of claim 4 wherein the axially spaced members have an associated magnetic skin depth and wherein the members have an axial thickness of approximately twice the skin depth.

6. The actuator of claim 4 wherein the tube includes a plurality of laminations generally coaxially aligned with the field assembly.

7. The actuator of claim 4 wherein the tube comprises a sheet of ferromagnetic material rolled to form a plurality of circumferential layers.

8. An electromagnetic actuator for opening and closing a valve in an internal combustion engine, the actuator comprising:

a non-magnetic shaft connected to the valve;

an annular field assembly coaxially aligned with and secured to the shaft, the field assembly having a plurality of annular permanent magnets each creating a generally axially oriented magnetic field, and a plurality of annular ferromagnetic discs, the permanent magnetic alternately interposed with the ferromagnetic discs;

an annular armature assembly coaxially aligned with the field assembly, the armature assembly including a generally cylindrical ferromagnetic housing having a plurality of axially spaced members extending radially inward toward the field assembly and separating each of a plurality of coils, wherein electrical current applied to the armature assembly coils causes linear motion of the field assembly, shaft and the valve relative to the armature assembly.

9. A system for actuating an intake or exhaust valve of an internal combustion engine, the system comprising:

a linear DC machine including a cylindrical field assembly said field assembly having a plurality of permanent axially oriented annular permanent magnets separated by ferromagnetic material and mounted on a substantially non-magnetic shaft, adjacent magnets having like poles facing one another and a coaxially aligned cylindrical armature assembly having a plurality of coils arranged with alternating opposite magnetic fields, each coil axially separated from an adjacent coil by ferromagnetic material, the field assembly being linearly displaced relative to the armature assembly when a current is applied to the armature assembly, intake or exhaust valve being mechanically coupled to the field assembly; and a controller electrically connected to the armature for selectively supplying the current and reversing polarity of the current to actuate the valve.

* * * * *